US009914173B2

(12) United States Patent
Hsu et al.

(10) Patent No.: US 9,914,173 B2
(45) Date of Patent: Mar. 13, 2018

(54) PARTICLE PRODUCTION APPARATUS

(71) Applicant: Metal Industries Research & Development Centre, Kaohsiung (TW)

(72) Inventors: Tai-Hsin Hsu, Kaohsiung (TW); Yin Chuang, Kaohsiung (TW); Wen-Pin Chien, Hsinchu (TW); Chi-Ming Chang, Taichung (TW); Ho-Chung Fu, Kaohsiung (TW); Chang-Pen Chen, Kaohsiung (TW)

(73) Assignee: Metal Industries Research & Development Centre, Kaohsiung (TW)

( * ) Notice: Subject to any disclaimer, the term of this patent is extended or adjusted under 35 U.S.C. 154(b) by 86 days.

(21) Appl. No.: 14/953,434

(22) Filed: Nov. 30, 2015

(65) Prior Publication Data

US 2017/0080499 A1 Mar. 23, 2017

(30) Foreign Application Priority Data

Sep. 23, 2015 (TW) ..... 104131452 A

(51) Int. Cl.
*B22F 9/14* (2006.01)
*B21F 1/02* (2006.01)
(Continued)

(52) U.S. Cl.
CPC ..... *B22F 9/14* (2013.01); *B21C 19/00* (2013.01); *B21F 1/02* (2013.01); *B22F 1/0018* (2013.01); *B22F 2999/00* (2013.01)

(58) Field of Classification Search
CPC ..... B22F 9/14
(Continued)

(56) References Cited

U.S. PATENT DOCUMENTS 6,972,115 B1 * 12/2005 Ballard ..... B01J 19/088 422/186.04
2007/0101823 A1 5/2007 Sen et al.
(Continued)

FOREIGN PATENT DOCUMENTS

CN 1377297 A 10/2002
CN 204234485 U 4/2015
(Continued)

OTHER PUBLICATIONS

Abdullah Alqudami, et al., "Ag—Au alloy nanoparticles prepared by electro-exploding wire technique," Journal of Nanoparticle Research, vol. 10, Dec. 2007, pp. 1027-1036.
(Continued)

*Primary Examiner* — Scott Kastler
(74) *Attorney, Agent, or Firm* — JCIPRNET

(57) ABSTRACT

A particle production apparatus including a generating device, a conveying device, and a straightening device is provided. The generating device includes a tank filled with a dense medium, an electric power source, a first and a second electrical conducting element received in the dense medium and coupled to an anode and a cathode of the electric power source respectively. The conveying device is configured to convey a metal wire into the tank and make the metal wire to contact the first electrical conducting element and the second electrical conducting element in a straight-line direction, so as to produce an electric explosion to form a plurality of particles in the dense medium.

18 Claims, 6 Drawing Sheets

(51) Int. Cl.
*B21C 19/00* (2006.01)
*B22F 1/00* (2006.01)

(58) Field of Classification Search
USPC ..... 266/102
See application file for complete search history.

(56) References Cited

U.S. PATENT DOCUMENTS

2008/0216604 A1 9/2008 Cho et al.
2015/0000469 A1* 1/2015 Lee ..... B22F 9/14 75/354

FOREIGN PATENT DOCUMENTS

JP H02166202 6/1990
JP H04350107 12/1992
TW 201208790 3/2012
TW 201226073 7/2012

OTHER PUBLICATIONS

Shutesh Krishnan, et al., "Synthesis and growth kinetics of spindly CuO nanocrystals via pulsed wire explosion in liquid medium," Journal of Nanoparticle Research, vol. 15, Jan. 2013, pp. 1-9.
Duk-Hee Lee, et al., "Oleic-acid-assisted carbon coating on Sn nanoparticles for Li ion battery electrodes with long-term cycling stability," RSC Advances, vol. 4, Sep. 2014, pp. 44563-44567.
Chi-Ming Chang, et al., "Design of the millimeter-wire to nanoparticle generator and analysis of the synthesized nanoparticles," 33th Symposium on Spectroscopic Technologies and Surface Sciences, Jul. 15-17, 2015, pp. 1-4.
"Office Action of Taiwan Counterpart Application", dated Jul. 4, 2016, p. 1-p. 13, in which the listed references were cited.

* cited by examiner

PARTICLE PRODUCTION APPARATUS

CROSS-REFERENCE TO RELATED APPLICATION

This application claims the priority benefit of Taiwan application serial no. 104131452, filed on Sep. 23, 2015. The entirety of the above-mentioned patent application is hereby incorporated by reference herein and made a part of this specification.

BACKGROUND OF THE INVENTION

Field of the Invention

The invention relates to a straightening device and a particle production apparatus using the same.

Description of Related Art

Along with the continuous development of an application field of nanopowder, demand on quantity of nanoparticles has continuously increased, and in order to satisfy the demand of the nanoparticles, related practitioners devote to research and develop a mass production technique and an apparatus capable of improving productivity of the nanopowder while considering a property of the nanoparticles and production safety thereof.

Some practitioners produce the nanoparticles by using a chemical approach, during a manufacturing process adopting the chemical approach, since a chemical activity of the nanoparticles is required to adopt a proper reactant, besides some precious metals, the chemical approach is not suitable for producing general metal nanoparticles, and the manufacturing cost of the chemical approach is relatively high, and particle size distribution is relatively wide range. Some other practitioners produce the nanoparticles by using a metal sputtering vapour synthesis method, by which the particle size of the nanoparticles can be controlled by controlling a pressure and a temperature of an inert gas and a temperature of an evaporated substance. However, the metal vapour synthesis method has to be implemented under a vacuum environment, which is subjected to considerable restrictions in an actual production application. Therefore, most of the practitioners still produce the nanoparticles for smaller particle sizes by using a mechanical grinding method.

Taking a dry grinding method as an example, the powder is driven by the air and the particles are grinded into nanoparticles according to a particle impact principle. However, although the particle sizes of the nanoparticles produced according to the above grinding method are relatively small, during the manufacturing process, the smaller the particle size of the produced particles is, the more easier the particles float in the air to form nano dust, and the minimum ignition energy of the particles becomes smaller, such that the nano dust is easy to be ignited. Regarding a titanium powder and an iron powder with the particle size of a nano scale, the minimum ignition energy thereof is smaller than 1 mJ, and during the manufacturing process, due to the factors of static electricity, impact or open flame, it is extremely easy to cause combustion and explosion, which causes many crises of fires and explosions during the process of manufacturing the nanoparticles.

SUMMARY OF THE INVENTION

Accordingly, the invention is directed to a straightening device and a particle production apparatus using the same, in which a metal wire is continuously input to a generating device to continuously generate particles, and the generated particles are distributed in a dense medium, so as to greatly improve productivity and safety of a mass production.

The invention provides a particle production apparatus including a generating device, a conveying device, and a straightening device. The generating device includes a tank, an electric power source, a first electrical conducting element and a second electrical conducting element. The tank is filled with a dense medium in a liquid state. The first electrical conducting element and the second electrical conducting element are disposed in the dense medium of the tank, and are coupled to the electric power source. The conveying device is configured to convey a metal wire into the tank and make the metal wire to contact the first electrical conducting element and the second electrical conducting element, so as to produce an electric explosion to form a plurality of particles in the dense medium when the first electrical conducting element, the second electrical conducting element and the metal wire located therebetween are electrically conducted. The straightening device disposed between the conveying device and the generating device straightens the metal wire along a straight-line direction for transmitting to the generating device, such that the metal wire contacts the first electrical conducting element and the second electrical conducting element along the straight-line direction.

The invention provides a straightening device, which is adapted to straighten a metal wire. The straightening device includes a stage, an ultrasonic source and a pressure head. The metal wire is driven to pass through the stage and is carried by the stage. The pressure head covering the stage is connected to the ultrasonic source, such that an ultrasonic wave is exerted to the metal wire passing through the stage to eliminate an internal stress of the metal wire, so as to straighten the metal wire along a straight-line direction.

According to the above description, the straightening device and the particle production apparatus of the invention may control a length of the metal wire and straighten the same to effectively control a particle size of the particles generated during continuous electric explosion of the metal wire.

In other words, based on arrangement of a shifting device and the conveying device, the length of the metal wire between the first electrical conducting element and the second electrical conducting element may reach the predetermined length, which represents that the particle production apparatus is able to maintain consistency of the length of the metal wire in each electric explosion process, and meanwhile the straightening device may effectively eliminate the internal stress of the metal wire and maintain the shape of the metal wire along a fixed direction for contacting the electric conducting elements, so as to avoid a bending status of the metal wire when the metal wire contacts the electrical conducting elements to influence the quality of the particles obtained through the electric explosion.

Moreover, when a surface contour of the electrical conducting elements is changed due to the previous explosion, the shifting device may adjust a distance between the electrical conducting elements to effectively maintain consistency of the length of the metal wire between the electrical conducting elements.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated and constituted a part of this specification. The drawings illustrate embodiments of the invention and, together with the description, serve to explain the principles of the invention.

DESCRIPTION OF EMBODIMENTS

Figure 1:
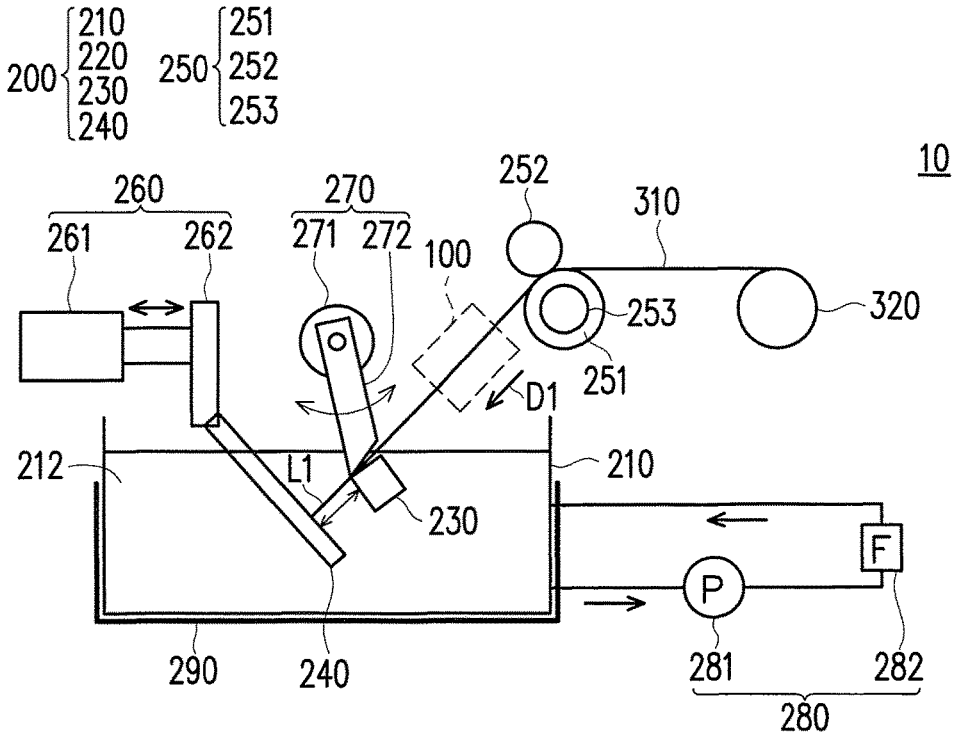
FIG. 1 is a schematic diagram of a particle production apparatus according to an embodiment of the invention.
Figure 2:
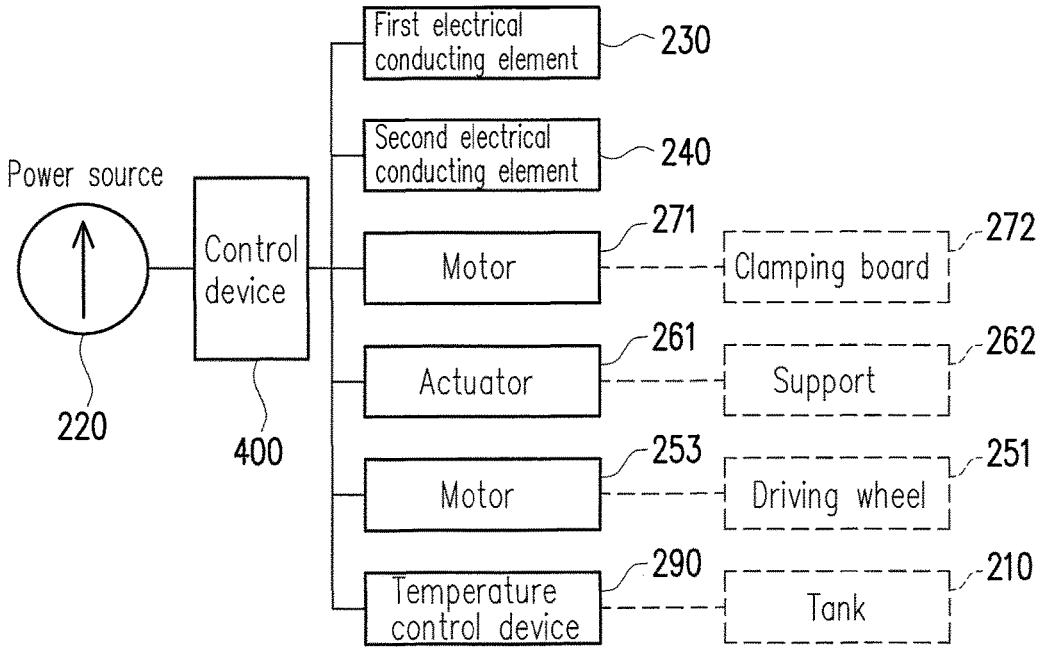
FIG. 2 is a schematic diagram illustrating electrical connections of related components of FIG. 1.

FIG. 1 is a schematic diagram of a particle production apparatus according to an embodiment of the invention. FIG. 2 is a schematic diagram illustrating electrical connections of related components of FIG. 1. Referring to FIG. 1 and FIG. 2, in the present embodiment, the particle production apparatus 10 includes a generating device 200, a conveying device 250, a control device 400, a straightening device 100 and a shifting device 260. The generating device 200 includes a tank 210, an electric power source 220, a first electrical conducting element 230 and a second electrical conducting element 240. The tank 210 is filled with a dense medium 212 in a liquid state, and the first electrical conducting element 230 and the second electrical conducting element 240 are disposed in the dense medium 212 and are electrically connected to an anode and a cathode of the electric power source 220, respectively, and the control device 400 is electrically connected thereto for controlling a relative voltage between the first electrical conducting element 230 and the second electrical conducting element 240.

A metal wire coil 320 decoils and transmits a metal wire 310 into the dense medium 212 through the conveying device 250. Further, the conveying device 250 includes a motor 253, a driving wheel 251 and a driven wheel 252, where the motor 253 is electrically connected to and controlled by the control device 400 for driving the driving wheel 251 to rotate (meanwhile the driven wheel 252 is driven to rotate), such that the metal wire 310 can be clamped by the driving wheel 251 and the driven wheel 252 for transmitting to the dense medium 212. When the metal wire 310 sequentially contacts the first electrical conducting element 230 and the second electrical conducting element 240, since the first electrical conducting element 230, the second electrical conducting element 240 and the metal wire 310 therebetween are electrically conducted, a voltage can be provided to produce an electric explosion of the metal wire 310 to form a plurality of metal particles or metal compound particles in the dense medium 212. The voltage required for producing the electric explosion is, for example, 12V to 100V, which is determined by a length and a diameter of the metal wire 310, and compared with the existing technique that a high voltage (several kilovolts) is required to achieve the electric explosion, the invention has obvious effectiveness and safety.

In the present embodiment, the shifting device 260 is disposed opposite to the conveying device 250. The shifting device 260 includes an actuator 261 and a supporter 262, where the actuator 261 is, for example, a step motor, a voice coil motor, an oil hydraulic motor, a piezoelectric actuator, etc., which is electrically connected to the control device 400, and is controlled by the same to move back and forth to shift the supporter 262 (shown as a double arrow direction of FIG. 1), and the second electrical conducting element 240 is disposed on the supporter 262 to move back and forth along with the supporter 262. In this way, the second electrical conducting element 240 is controlled for adjusting a distance between the second electrical conducting element 240 and the first electrical conducting element 230. In other words, the user may operate the control device 400 to control the shifting device 260 and the conveying device 250, so as to adjust the distance between the second electrical conducting element 240 and the first electrical conducting element 230, and accordingly control the metal wire 310 therebetween to reach a predetermined length L1, and further according to a corresponding relationship of a wire length in the electric explosion, the user may control the predetermined length L1 of the metal wire 310 in the electric explosion to control a range of a particle size distribution of the particles generated in the electric explosion. Here, the particle production apparatus 10 of the present embodiment may produce particles with the particle size below 100 nm or particles with the particle size above 100 nm according to different manufacturing conditions (for example, a material of the metal wire 310, a type of the dense medium 212, a voltage of the electric explosion, etc.).

Referring to FIG. 1 and FIG. 2, in the present embodiment, the dense medium 212 includes a hydrocarbon compound, or hydrocarbon oxygen compound, which can be a non-conductive liquid such as pure water, butanol, ethylene glycol, oleic acid, hexamethylene or heavy oil, etc., where a part of the dense medium 212 is reacted with the metal wire 310 to form a complex during the electric explosion, such as the oleic acid, etc.

Moreover, the particle production apparatus 10 of the present embodiment further includes a clamping device 270, which is electrically connected to the control device 400 and is driven by the control device 400 to open and close relatively to the first electrical conducting element 230. As shown in FIG. 1, the clamping device 270 includes a motor 271 and a clamping board 272 installed on the motor 271. The control device 400 drives the motor 271 to rotate the clamping board 272 to lean against a side edge (or release from the side edge) of the first electrical conducting element 230, so that the metal wire 310 can be clamped between the clamping board 272 and the first electrical conducting element 230 when the clamping device 270 is closed relatively to the first electrical conducting element 230. Meanwhile, based on the above move, the metal wire 310 is fixed between the first electrical conducting element 230 and the second electrical conducting element 240, and based on the concept that the current is transmitted through the shortest path, the metal wire 310 electrically conducted between the first electrical conducting element 230 and the second electrical conducting element 240 is pressed by the clamping board 272 to closely contact the side edge of the first electrical conducting element 230, so as to maintain the aforementioned predetermined length L1 to implement the electric explosion process. Meanwhile, based on the above move, a front end of the metal wire 310 remained after the electric explosion can be aligned with the side edge (i.e., a clamping point between the clamping board 272 and the first electrical conducting element 230) of the first electrical conducting element 230.

Figure 3:
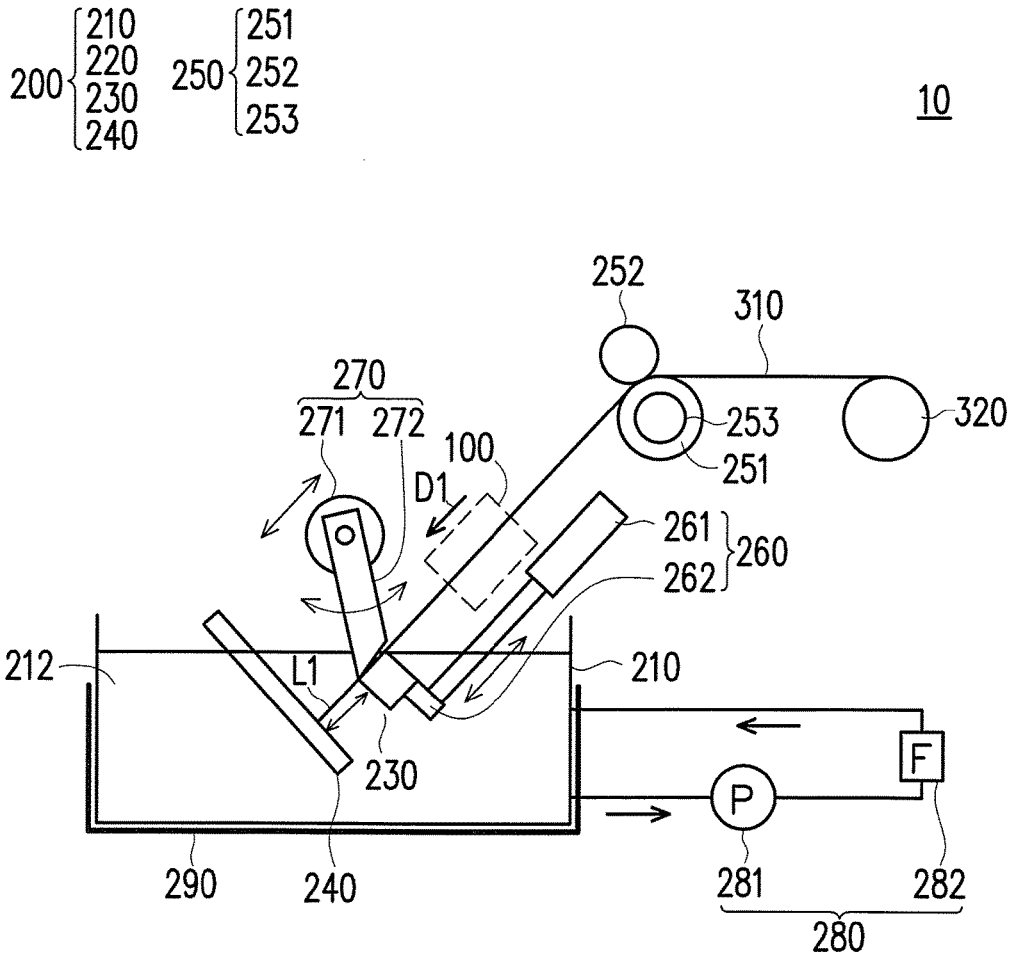
FIG. 3 is a schematic diagram of a particle production apparatus according to another embodiment of the invention.

However, the method for adjusting the length of the metal wire 310 between the first electrical conducting element 230 and the second electrical conducting element 240 is not limited by the present embodiment. FIG. 3 is a schematic diagram of a particle production apparatus according to another embodiment of the invention. Referring to FIG. 3, which is different from the embodiment of FIG. 1, the first electrical conducting element 230 is disposed on the supporter 262 of the shifting device 260 of the present embodiment, and the first electrical conducting element 230 is driven by the actuator 261 to move toward or away from the second electrical conducting element 240 (i.e., the second electrical conducting element 240 is regarded to be in a fixed state), shown as a double arrow direction of FIG. 3. The above move may also achieve the effect of adjusting the relative distance between the first electrical conducting element 230 and the second electrical conducting element 240, i.e., achieve the effect of adjusting the length of the metal wire 310 that is the same as that of the aforementioned embodiment.

Figure 4:
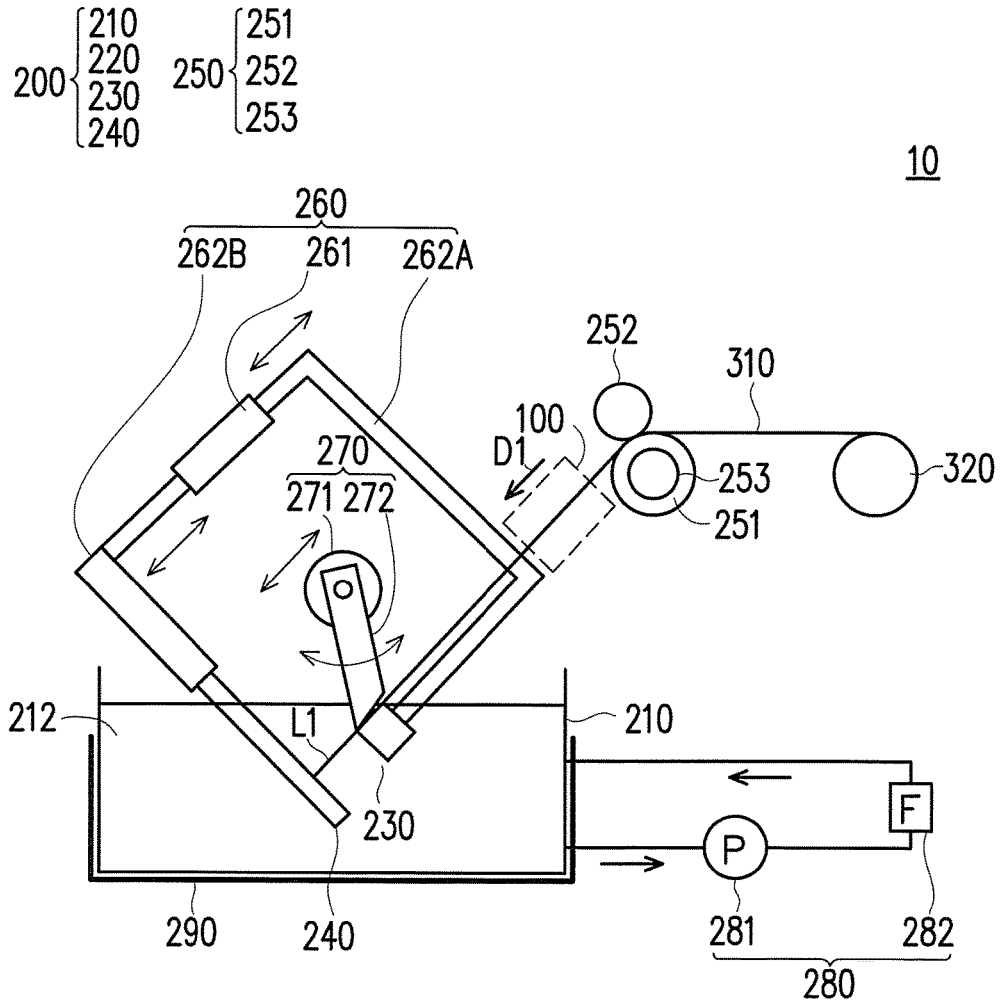
FIG. 4 is a schematic diagram of a particle production apparatus according to another embodiment of the invention.

FIG. 4 is a schematic diagram of a particle production apparatus according to another embodiment of the invention. In the present embodiment, the first electrical conducting element 230 is disposed on a supporter 262A of the shifting device 260, and the second electrical conducting element 240 is disposed on a supporter 262B of the shifting device 260, such that the actuator 261 drives the first electrical conducting element 230 and the second electrical conducting element 240 to move toward or away from each other. Certainly, in another embodiment that is not shown, a plurality of actuators can be used to achieve an effect of respectively driving the first electrical conducting element 230 and the second electrical conducting element 240, and detail thereof is not repeated.

It should be noted that in the embodiment of FIG. 3, the clamping device 270 used for clamping the metal wire 310 can move along a direction the same with that of the first electrical conducting element 230, shown as the bi-arrow direction of FIG. 3. Namely, in the present embodiment, the clamping device 270 and the shifting device 260 are synchronous to ensure the clamping board 272 to lean against a front edge of the first electrical conducting element 230 that is close to the second electrical conducting element 240 to guarantee the predetermined length L1 of the metal wire 310. The method for driving the clamping device 270 is not limited by the invention, and the clamping device 270 can be driven by the actuator 261 of the shifting device 260 to synchronously shift along with the first electrical conducting element 230 on the support 262, or can be driven by another actuator (not shown), and the another actuator is electrically connected to the control device 400, and the control device 400 may synchronously activate the two actuators.

Figure 5:
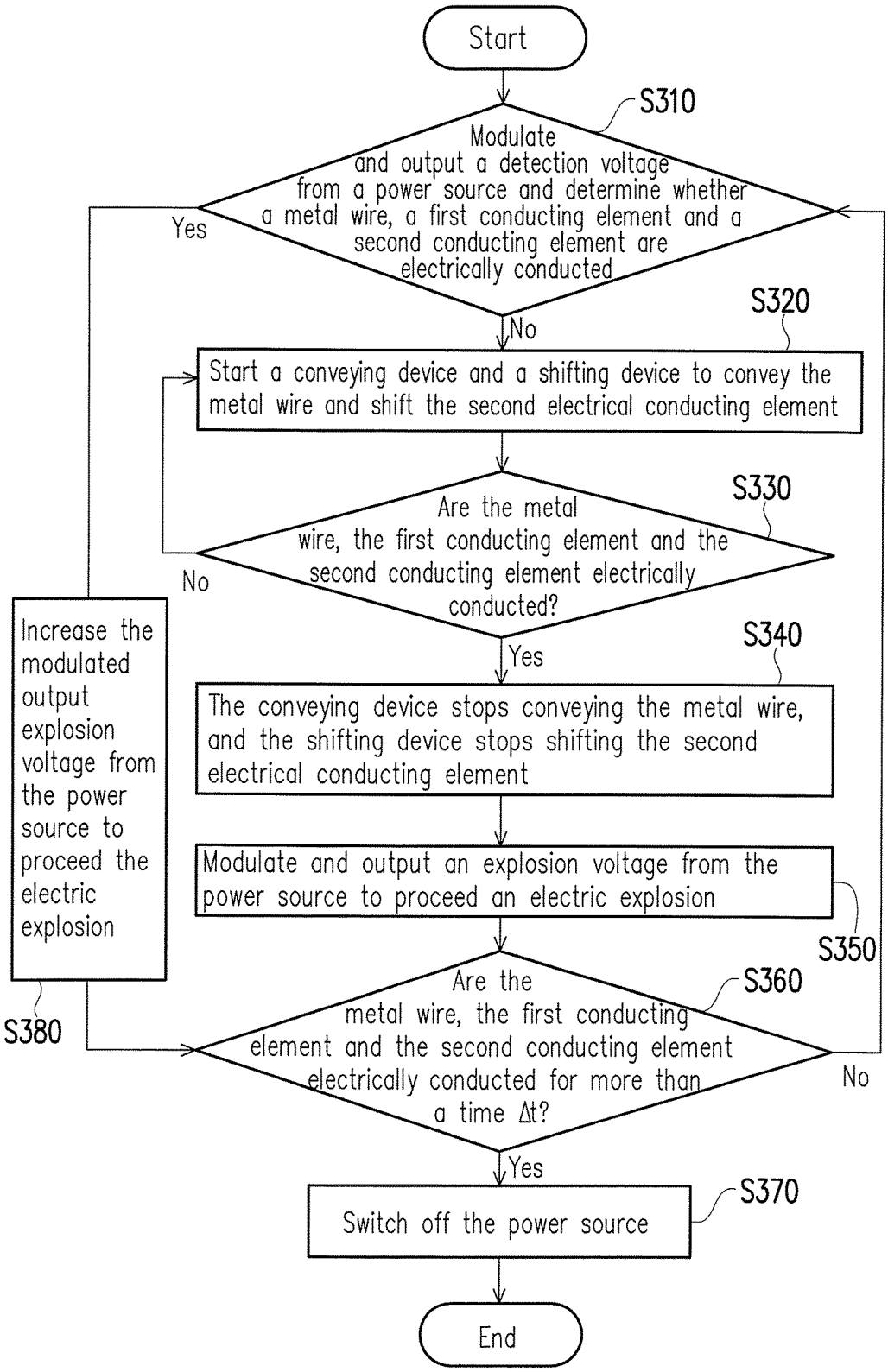
FIG. 5 is a flowchart illustrating an operation process of the particle production apparatus of FIG. 1 and FIG. 2.

FIG. 5 is a flowchart illustrating an operation process of the particle production apparatus of FIG. 1 and FIG. 2. Referring to FIG. 1, FIG. 2 and FIG. 5, in the present embodiment, in step S310, the control device 400 controls the electric power source to modulate and output a predetermined detection voltage for detecting whether the first electrical conducting element 230 and the second electrical conducting element 240 of the generating device 200 are electrically conducted. If not, in step S320, the control device 400 further drives the shifting device 260 and the conveying device 250, where the shifting device 260 drives the second electrical conducting element 240 to move to a predetermined position, and the conveying device 250 conveys the metal wire 310 to enter the dense medium 212, where the metal wire 310 passes through the first electrical conducting element 230 to move toward the second electrical conducting element 240. Then, in step S330, the control device 400 exerts the aforementioned detection voltage to confirm whether the metal wire 310, the first electrical conducting element 230 and the second electrical conducting element 240 are electrically conducted. If not, the flow returns to the step S320 to continually drive the conveying device 250 and the shifting device 260. If yes, it is represented that the metal wire 310 has completed contacting the first electrical conducting element 230 and the second electrical conducting element 240, so that in step S340, the conveying device 250 stops conveying the metal wire 310, and the shifting device 260 stops shifting the second electrical conducting element 240. Then, the control device 400 decreases the output voltage of the electric power source 220 of the generating device 200 to the minimum value (for example, decreases the output voltage to 0), and in step S350, the control device 400 controls the electric power source 220 to modulate and output the predetermined electric explosion voltage, such that the metal wire 310 between the first electrical conducting element 230 and the second electrical conducting element 240 produces the electric explosion to generate the particles for distributing in the dense medium 212. It should be noted that the aforementioned detection voltage is smaller than the electric explosion voltage.

After the metal wire 310 produces the electric explosion, in step S360, the control device 400 detects whether the metal wire 310, the first electrical conducting element 230 and the second electrical conducting element 240 are electrically conducted, i.e., the control device 400 detects whether the metal wire 310, the first electrical conducting element 230 and the second electrical conducting element 240 are electrically conducted after a predetermined time $\Delta t$ (for example, at least 0.001 second), so as to determine whether the electric explosion is complete. If not, i.e., the first electrical conducting element 230 and the second electrical conducting element 240 are not electrically conducted, the control device 400 controls the electric power source 220 to modulate and output the predetermined detection voltage, i.e., the flow returns to the step S310 to confirm the electric conduction state between the first electrical conducting element 230 and the second electrical conducting element 240 by using the detection voltage.

Conversely, after the predetermined time $\Delta t$, when the control device 400 detects that the first electrical conducting element 230 and the second electrical conducting element 240 are still electrically conducted, it represents that the previous electric explosion is not successfully produced, and in step S370, the control device 400 controls to cut off the input voltage between the first electrical conducting element 230 and the second electrical conducting element 240, so as to avoid a short circuit of the system. It should be noted that the operation flow of FIG. 3 is executed again, i.e., the step S310 is executed to perform detection by using the detection voltage with a voltage value smaller than that of the electric explosion voltage, and due to that the metal wire 310 does not produce the electric explosion in the previous operation, the first electrical conducting element 230 and the second electrical conducting element 240 and the metal wire 310 maintain the previous electrical conduction state. Then, a step S380 is execute, by which the control device 400 drives the electric power source 220 to increase the electric explosion voltage, so as to implement the electric explosion of the metal wire 310.

Moreover, it should be noted that as describe above, the shifting device 260 can shift the second electrical conducting element 240 to adjust the distance between the second electrical conducting element 240 and the first electrical conducting element 230, so that in the step S320 of the present embodiment, when the control device 400 detects that a surface of the second electrical conducting element 240 is uplifted through the operation of conveying the metal wire 310 by using the conveying device 250, the control device 400 drives the shifting device 260 to move the second electrical conducting element 240 away from the first electrical conducting element 230, such that the metal wire 310 between the first electrical conducting element 230 and the second electrical conducting element 240 is maintained to the aforementioned predetermined length L1.

In detail, the length of the metal wire 310 conveyed by the conveying device 250 is a fixed setting value (i.e., the aforementioned predetermined length L1), so that after the previous electric explosion is completed, the metal wire 310 is again conveyed by the setting value by the conveying device 250. However, when the surface of the second electrical conducting element 240 is uplifted due to deposition of the particles generated in the previous electric explosion, the metal wire 310 may contact the second electrical conducting element 240 to implement electrical conduction before it is conveyed by the predetermined length L1, and now the length of the metal wire 310 used for implementing the electric explosion is substantially smaller than the predetermined length L1. Therefore, the control device 400 takes a difference between the length of the currently conveyed metal wire 310 and the predetermined length L1 as a reference for driving the shifting device 260 to move the second electrical conducting element 240 away from the first electrical conducting element 230, and meanwhile controls the conveying device 250 to continually convey the metal wire 310 to the predetermined length L1, such that the present electric explosion can still be implemented under the state that the metal wire 310 is maintained to the predetermined length L1. In this way, the particle quality (particle size distribution) of each electric explosion is effectively maintained.

Conversely, when the surface of the second electrical conducting element 240 is pitted due to the previous electric explosion, the metal wire 310 cannot contact the second electrical conducting element 240 to implement electrical conduction after it is conveyed by the predetermined length L1, and now the conveying device 250 continually conveys the metal wire 310 to exceed the predetermined length L1 until the metal wire 310 contacts the second electrical conducting element 240 to implement the electrical conduction. The control device 400 then detects a length of the metal wire 310 exceeding the predetermined length L1, and takes the exceeding length as a reference for driving the shifting device 260 to move the second electrical conducting element 240 toward the first electrical conducting element 230, and meanwhile controls the conveying device 250 to draw back the metal wire 310, such that the electric explosion can still be implemented under the state that the metal wire 310 is maintained to the predetermined length L1.

Figure 6:
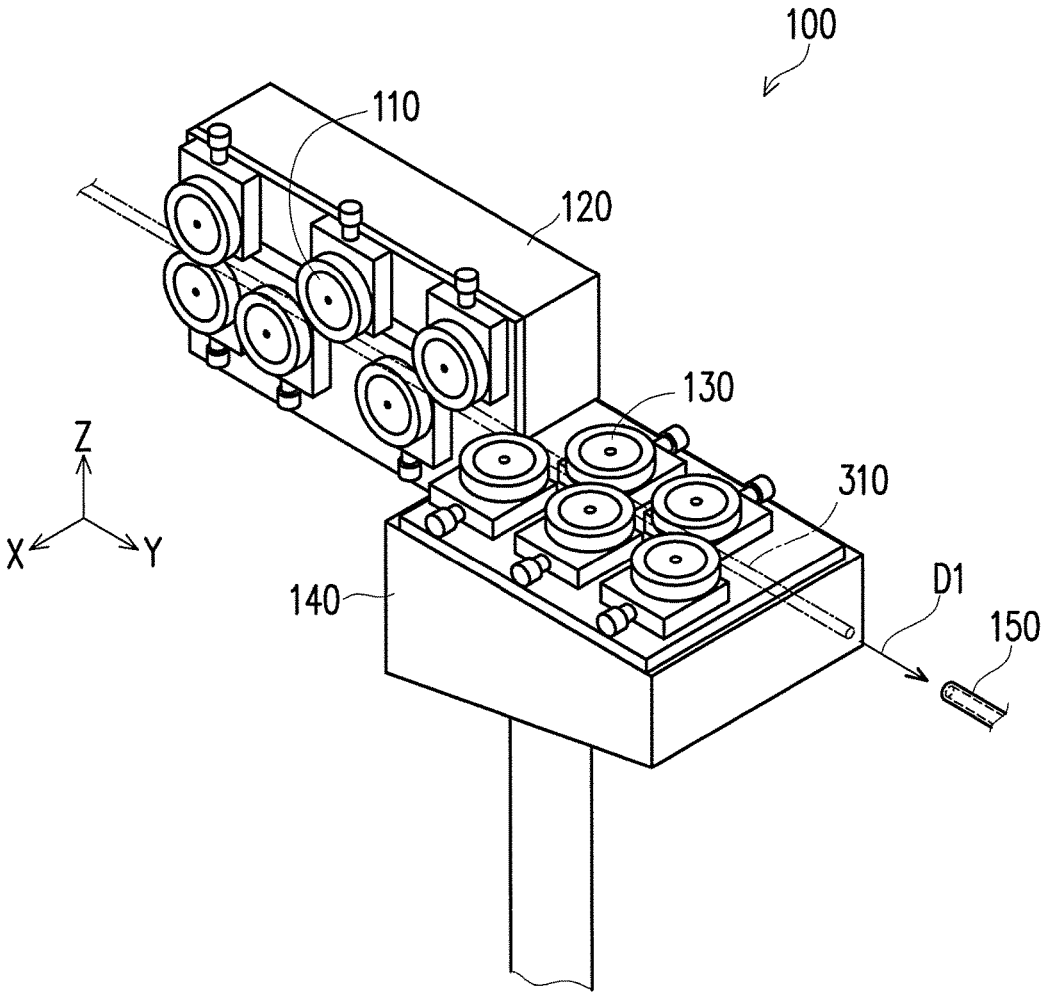
FIG. 6 is a partial schematic diagram of the particle production apparatus of FIG. 1.

FIG. 6 is a partial schematic diagram of the particle production apparatus of FIG. 1 to illustrate a structure of a straightening device. Referring to FIG. 1 and FIG. 6, in the present embodiment, the straightening device 100 includes a plurality of rollers 110 and 130 for straightening the metal wire 310 passing there through. As shown in FIG. 6, the straightening device 100 further includes carrier units 120 and 140 disposed on different planes, where a surface of the carrier unit 120 is substantially parallel to a Y-Z plane, and a surface of the carrier unit 140 is substantially parallel to an X-Y plane. The rollers 110 are disposed on the carrier unit 120, and the rollers 130 are disposed on the carrier unit 140. In this way, when the metal wire 310 passes through the carrier unit 120, the metal wire 310 is rolled by the rollers 110 in two ways along a Z-axis, and when the metal wire 310 passes through the carrier unit 140, the metal wire 310 is rolled by the rollers 130 in two ways along an X-axis. In this way, after the rolling of the straightening roller set, collimation of the metal wire 310 along a straight-line direction D1 is maintained. A tension of the metal wire 310 can be controlled by adjusting positions of the rollers 110 (or 130) on the same carrier unit 120 (or 140), so as to adjust collimation direction of the metal wire 310. For example, positions of the rollers 110 on the carrier unit 120 can be adjusted relative to the metal wire 310 along the Z-axis, and positions of the rollers 130 on the carrier unit 140 can be adjusted relatively to the metal wire 310 along the X-axis.

Moreover, the straightening device 100 further includes a pipe 150 (only a part of which is illustrated), which is disposed between the aforementioned straightening roller set and the first electrical conducting element 230. The pipe 150 extends along the straight-line direction D1, and the metal wire 310 penetrates through the pipe 150 and is straightened along the straight-line direction D1. Meanwhile, the pipe 150 guides the metal wire 310 to the first electrical conducting element 230.

Figure 7:
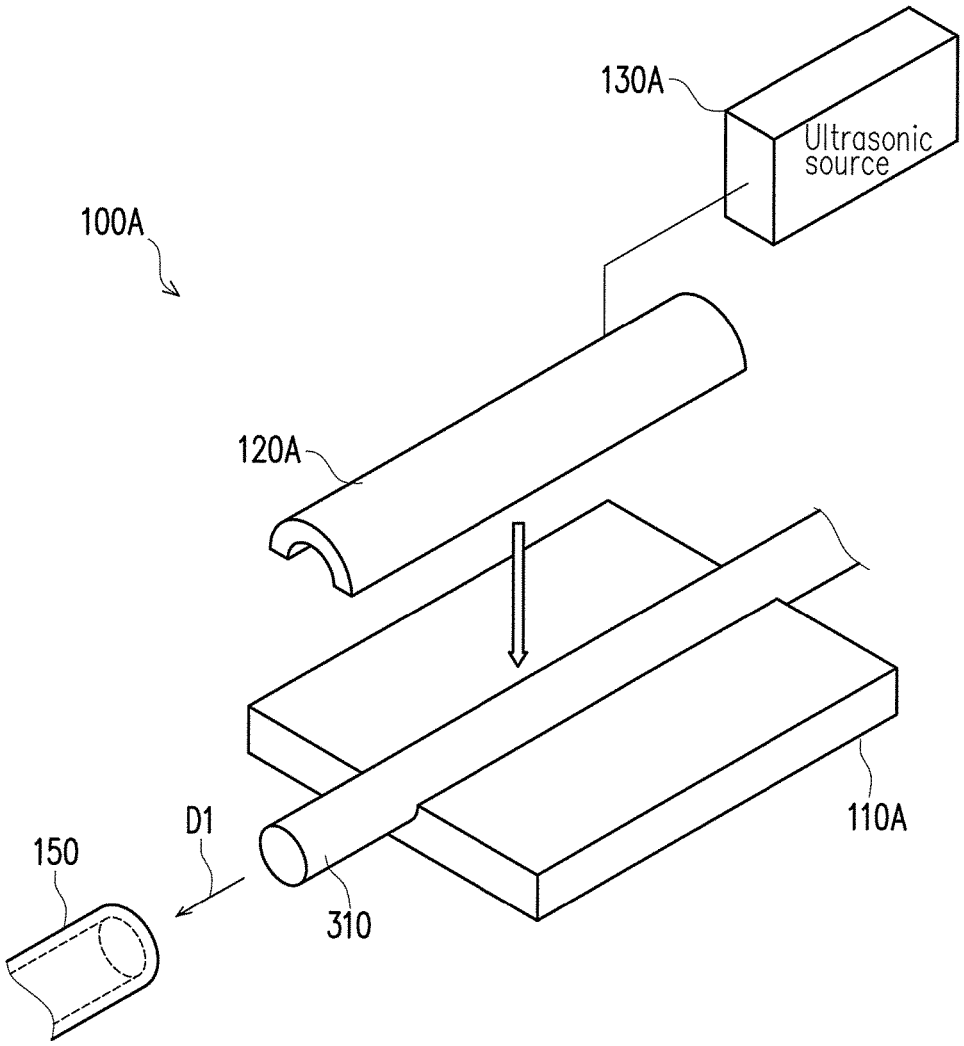
FIG. 7 is a schematic diagram of a straightening device according to another embodiment of the invention.

FIG. 7 is a schematic diagram of a straightening device according to another embodiment of the invention. Referring to FIG. 7, in the present embodiment, the straightening device 100A includes a stage 110A, an ultrasonic source 130A and a pressing head 120A. The metal wire 310 is driven to pass through the stage 110A and is carried by the stage 110A. The pressing head 120A covering the stage 110A is connected to the ultrasonic source 130A, such that an ultrasonic wave is exerted to the metal wire 310 passing through the stage 110A for eliminating internal stresses of the metal wire 310, so as to straighten the metal wire 310 along the straight-line direction D1. Similarly, the metal wire 310 straightened by the ultrasonic wave is straightened and guided to the first electrical conducting element 230 through the pipe 150.

Moreover, in another embodiment that is not illustrated, the straightening device may also include an electrical pulse straightening module, i.e., after a decoiling or coiling device bracing the metal wire, the metal wire is heated by a high-energy electrical pulse, and when the metal wire is softened, it is stretched by using a mould, so as to obtain the metal wire with better collimation and eliminate an internal stress therein.

According to the above description, the metal wire 310 with a wire diameter smaller than 1 mm can be straightened by the aforementioned straightening device 100 or 100A and transmitted into the dense medium 212 to implement the electric explosion, so as to effectively avoid quality unstableness of the electric explosion due to bending or deformation of the metal wire 310 occurred during a conveying process thereof.

On the other hand, referring to FIG. 1, in the present embodiment, the particle production apparatus 10 further includes a collecting device 280 connected to the tank 210, and the dense medium 212 in the tank 210 can be cycled and filtered through the collecting device 280. The collecting device 280 of the present embodiment includes a filter element 282 and a pump 281 configured to provide a cycling power to the dense medium 212 which the filtered dense medium 212 flows again back to the tank 210. The filter element 282 is, for example, a continuous centrifugal machine or a filter paper, which is used for collecting the particles distributed in the dense medium 212.

Moreover, the particle production apparatus 10 further includes a temperature control device 290 disposed at the tank 210 for adjusting a temperature of the dense medium 212 in the tank 210. Taking a copper wire as an example, the copper wire may have different patterns after the electric explosion in deionized water under different temperatures, where when the temperature of the deionized water is 1° C., the copper wire forms spherical copper particles after the electric explosion, and when the temperature of the deionized water is 60° C., the copper wire forms spindly copper oxide after the electric explosion. In this way, the user may operate the temperature control device 290 through the control device 400 to make the dense medium 212 to reach a request temperature.

Figure 8:
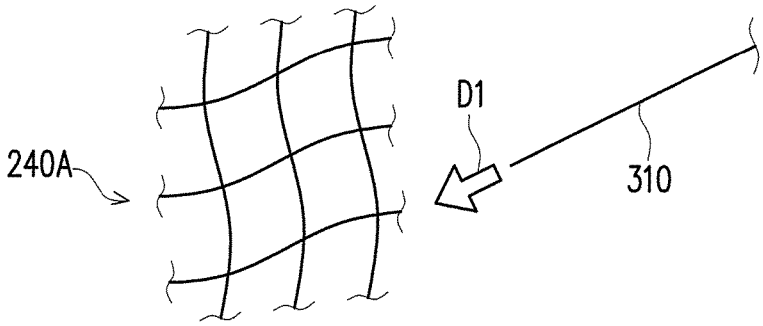
FIG. 8 is a schematic diagram of a second electrical conducting element according to another embodiment of the invention.

Moreover, FIG. 8 is a schematic diagram of a second electrical conducting element according to another embodiment of the invention. Referring to FIG. 8 and FIG. 1, a difference between the present embodiment and the aforementioned embodiment is that the second electrical conducting element 240 of FIG. 1 is substantially a plate-like structure, and the second electrical conducting element 240A of the present embodiment is substantially a mesh structure, which is, for example, constructed by conductive fine lines.

In summary, in the embodiments of the invention, the straightening device and the particle production apparatus of the invention may control a length of the metal wire and straighten the same to effectively control a particle size of the particles generated during continuous electric explosion of the metal wire.

The shifting device is used for adjusting a distance between the second electrical conducting element and the first electrical conducting element. When a contour of the surface of the second electrical conducting element is changed due to the previous electric explosion, the length of the metal wire prepared for the next electric explosion is liable to be inconsistent, so that by using the conveying device in collaboration with the shifting device, the length of the metal wire between the first electrical conducting element and the second electrical conducting element may reach the predetermined length, so as to maintain the consistency of the length of the metal wire to guarantee the quality (particle size distribution) of the particles obtained after the electric explosion.

Moreover, the straightening device is used for performing a straightening operation on the metal wire, such that the metal wire is maintained straight at the moment of contacting the second electrical conducting element, and according to such move, consistency of the length of the metal in each electric explosion is maintained to guarantee the quality of the particles obtained after the electric explosion. In the aforementioned embodiments, besides the pipe with a specific extending direction being adopted to straighten the metal wire, the ultrasonic wave or electrical pulse heating can also be adopted to straighten the metal wire and eliminate the internal stress of the metal wire.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A particle production apparatus, comprising:

a generating device, including a tank, an electric power source, a first electrical conducting element and a second electrical conducting element, wherein the tank is filled with a dense medium, the first electrical conducting element and the second electrical conducting element disposed in the tank are coupled to the electric power source;

a conveying device, conveying a metal wire into the tank;

a straightening device, straightening the metal wire along a straight-line direction for transmitting to the generating device;

a shifting device, wherein at least one of the first electrical conducting element and the second electrical conducting element is disposed on the shifting device, and the shifting device adjusts a distance between the first electrical conducting element and the second electrical conducting element;

a control device, coupled to the electric power source, the first electrical conducting element, the second electrical conducting element, the conveying device and the shifting device, driving the shifting device and the conveying device to adjust the metal wire between the first electrical conducting element and the second electrical conducting element to a predetermined length, so as to electrically conduct the first electrical conducting element, the metal wire and the second electrical conducting element, wherein the control device controls the electric power source to output a predetermined electric explosion voltage; and a clamping device, coupled to the control device and driven by the control device to open and close relatively to the first electrical conducting element, wherein when the clamping device is closed relatively to the first electrical conducting element, the metal wire is clamped between the clamping device and the first electrical conducting element, so as to maintain the metal wire between the first electrical conducting element and the second electrical conducting element to the predetermined length.

2. The particle production apparatus of claim 1, wherein the control device controls the electric power source of the generating device to modulate and output a predetermined detection voltage for detecting an electrical conduction state between the first electrical conducting element and the second electrical conducting element of the generating device.

3. The particle production apparatus of claim 2, wherein when the control device detects that the first electrical conducting element and the second electrical conducting element are not electrically conducted, the control device starts the conveying device and the shifting device for conveying the metal wire and shifting the second electrical conducting element.

4. The particle production apparatus of claim 2, wherein when the metal wire reaches the predetermined length, the metal wire, the first electrical conducting element and the second electrical conducting element are electrically conducted, and the control device stops driving the conveying device and the shifting device, and the control device adjusts an output voltage of the electric power source of the generating device to a minimum value, and then modulates and outputs the predetermined electric explosion voltage to produce the electric explosion of the metal wire between the first electrical conducting element and the second electrical conducting element.

5. The particle production apparatus of claim 4, wherein a voltage range of the electric explosion is between 12V and 100V.

6. The particle production apparatus of claim 4, wherein when the control device is still detecting that the first electrical conducting element and the second electrical conducting element are electrically conducted after a predetermined time, the control device cuts off the voltage input between the first electrical conducting element and the second electrical conducting element.

7. The particle production apparatus of claim 4, wherein when the control device detects that the first electrical conducting element and the second electrical conducting element are not electrically conducted for the predetermined time after the control device inputting the electric explosion voltage to the metal wire, the control device controls the electric power source to modulate and output the predetermined detection voltage.

8. The particle production apparatus of claim 7, wherein when the control device drives the electric power source of the generating device to output the predetermined electric explosion voltage, and the electric explosion of the metal wire is failed under the first electrical conducting element and the second electrical conducting element are electrically conducted after the predetermined time, the control device cuts off the voltage input between the first electrical conducting element and the second electrical conducting element and again outputs the predetermined detection voltage for detecting that the first electrical conducting element and the second electrical conducting element are still electrically conducting, and driving the electric power source to increase and output the electric explosion voltage.

9. The particle production apparatus of claim 1, wherein the straightening device is selected from the group consisting of a straightening roller set, an electrical pulse straightening module, an ultrasonic straightening module and a combination thereof.

10. The particle production apparatus of claim 1, wherein the dense medium is selected from the group consisting of hydrocarbon compound, hydrocarbon oxygen compound, water, butanol, ethylene glycol, hexamethylene, oleic acid, heavy oil and a combination thereof.

11. The particle production apparatus of claim 1, wherein the second electrical conducting element has a mesh structure.

12. The particle production apparatus of claim 1, further comprising:

a temperature control device, disposed on the tank and coupled to the control device for maintaining a temperature of the dense medium.

13. The particle production apparatus of claim 1, further comprising:

a collecting device, coupled to the control device and coupled to the tank, configured to cycle the dense medium and collect the particles in the dense medium, wherein the collecting device comprises a continuous centrifugal machine or a filter.

14. The particle production apparatus of claim 1, wherein when the control device detects that a surface of the second electrical conducting element is uplifted through the operation of conveying the metal wire, the control device drives the shifting device to move the second electrical conducting element away from the first electrical conducting element, such that the metal wire between the first electrical conducting element and the second electrical conducting element is maintained to the predetermined length.

15. The particle production apparatus of claim 1, wherein when the control device detects that a surface of the second electrical conducting element is pitted through the operation of conveying the metal wire, the control device drives the shifting device to move the second electrical conducting element toward the first electrical conducting element, such that the metal wire between the first electrical conducting element and the second electrical conducting element is maintained to the predetermined length.

16. The particle production apparatus of claim 1, wherein the straightening device comprises:

a stage, wherein the metal wire is driven to pass through the stage;

an ultrasonic source; and a pressing head, covering the stage and coupling to the ultrasonic source, such that an ultrasonic wave is exerted to the metal wire for eliminating internal stresses of the metal wire, so as to straighten the metal wire along the straight-line direction.

17. The particle production apparatus of claim 16, wherein the straightening device further comprises:

a pipe, located beside the stage, wherein the metal wire penetrates through the pipe after the metal wire is straightened by the ultrasonic wave.

18. The particle production apparatus of claim 16, wherein a wire diameter of the metal wire is smaller than 1 mm.

* * * * *